United States Patent [19]

Dolison et al.

[11] Patent Number: 4,838,345

[45] Date of Patent: Jun. 13, 1989

[54] COMBINED AIR CONDITIONING AND VENTILATION ASSEMBLY

[76] Inventors: Dewey H. Dolison, 4645 SW. 64 Ave., Miami, Fla. 33155; William H. Rahn, 1200 N. Shore Dr., No. 205, St. Petersburg, Fla. 33701

[21] Appl. No.: 843,496

[22] Filed: Mar. 24, 1986

[51] Int. Cl.[4] ..... F25B 29/00

[52] U.S. Cl. ..... 165/48.1; 98/33.1; 236/49.3

[58] Field of Search ..... 236/49; 98/33.1, 34.5, 98/34.6, 42.06, 42.09; 165/48.1, 54

[56] References Cited

U.S. PATENT DOCUMENTS

| | | | |
|---|---|---|---|
| 2,004,927 | 6/1935 | Bulkeley | 165/48.1 X |
| 2,306,034 | 12/1942 | Bernhardt | 98/34.6 |
| 2,488,333 | 11/1949 | Schlachter | 98/33.1 X |
| 3,150,584 | 9/1964 | Allander | 98/33.1 |
| 3,835,758 | 9/1974 | Bean | 98/33.1 |
| 3,951,336 | 4/1976 | Miller et al. | 236/49 X |
| 4,496,526 | 2/1985 | Arenas | 165/48.1 X |
| 4,526,227 | 7/1987 | Baker | 98/34.6 X |

*Primary Examiner*—William E. Tapolcai
*Attorney, Agent, or Firm*—John Cyril Malloy

[57] ABSTRACT

An air conditioning assembly for maintaining a preferred temperature range within the interior of a building structure such as a commercial, industrial or office facility wherein such temperature maintenance becomes efficient and cost effective based in part on the return and supply of previously conditioned air from the interior of the building structure to an intake of the air conditioning assembly. The air intake from the interior of the building is selectively chosen from a first zone where warmer air is collected depending upon whether the air conditioning assembly is in a heating or cooling mode. The subject process thereby reduces the amount of energy wasted in previously heating or cooling the conditioned air supplied to the building interior.

12 Claims, 1 Drawing Sheet

COMBINED AIR CONDITIONING AND VENTILATION ASSEMBLY

BACKGROUND OF THE INVENTION

1. Field of The Invention

This invention is directed towards a combined air conditioning system incorporating selective ventilation in terms of removing air from the interior of a building which has already been "conditioned" in terms of either heating or cooling and supplying such previously conditioned air back to the air intake of an air conditioning assembly. This system thereby takes full advantage of natural heat accumulation within a building interior due to the existence of people, machines, etc. and recycled back to the intake of the air conditioning assembly of the heated or cooled air within the building interior.

2. Description of the Prior Art

The prior art is replete with ventilating and air conditioning systems structured either independently or in combination with one another which are specifically designed for operation in an effective, efficient manner to condition the air within a given building structure to the extent of either heating or cooling such conditioned air. The great increase in energy costs associated with air conditioning systems, particularly for industrial type facilities, has made the development and operation of efficient systems a necessity.

Various designs and operational characteristics have been attempted in order to provide a more efficient system incorporating a low cost of operation thereof. The following U.S. patents disclose structures, systems and operational characteristics which are representative of prior art attempts to provide a heating and cooling system having a maximum operating efficiency in terms of cost and performance. Representative prior art patents including Samuelsson, U.S. Pat. No. 3,742,837; Otsjuka, U.S. Pat. No. 3,802,327; Grun et al, U.S. Pat. No. 4,307,776; Thunberg, U.S. Pat. No. 4,391,321; and Beeler, U.S. Pat. No. 3,366,165.

In particular, the patent to Beeler as set forth above discloses an air conditioning system wherein separate systems are provided to compensate for the heat load passing through the wall of the structure being conditioned. These separate systems accommodate the heat generated internally by the lights in the structure and for the heat and moisture produced by the people occupying the interior of the structure. It is set forth and in this manner, the system performs most efficiently since it is not necessary to provide fresh humidity controlled air to one or more of the above set forth systems disclosed therein. More specifically, a perimeter system controls the flow of heat through the walls and roof of the building, a light cooling system controls the heating of the interior of the building and interior system supplies properly treated air to contact with people occupying the building.

Even in light of the above prior art systems and structures, there is a need for a preferred combined air conditioning and ventilating system including structure which utilizes "conditioned" air forced into the interior conditioned space as an air supply for the air conditioning assembly. Accordingly, greater efficiency and low cost of operation results in supplying somewhat heated air to the air conditioning assembly when in its heated air mode and conversely somewhat cool or cooler air is supplied to the intake of the air conditioning system when it is in its air cooling mode.

SUMMARY OF THE INVENTION

This invention is directed to a system for temperature maintenance within the interior of a building structure, preferably but not necessarily limited to building structures housing more industrialized facilities. More specifically, an air conditioning assembly is mounted either inside or outside of the building interior to be conditioned and may be of substantially conventional design capable of being operated in both an air cooling mode and an air heating mode to alternately cool and heat a building interior and the contents, including people therein. It should be noted that while represented as a single unit, the air conditioning assembly could include a two piece unit comprising a separate condensor unit and air handler. However, the subject air conditioning assembly is used in combination with a ventilation system which serves to collect air in various predetermined spaces or "zones" of the building interior being air conditioned and return such "preconditioned" air back to the intake of the air conditioning assembly for "recycling."

More specifically, and for purposes of example, operation of the air conditioning assembly occurs in a somewhat conventional manner in that, for instance, during the summer or warmer months of the year, the air conditioning assembly is operating in an air cooling mode. Accordingly, cooled air is delivered by delivery ducts into the building interior. In accordance with the normal rules of convection, the cooler air collects at the lower portion of the building interior in what may be referred to as a second zone or space for collection of cooler air accumulated within the building interior. A first zone or collection space for the warmer air is located in the uppermost areas of the building interior substantially adjacent to an immediately beneath the ceiling or roof structure of the conditioned building interior. In order to reduce weight in the amount of energy expended in cooling the air fed into the building interior, a delivery duct system is incorporated in the ventilation system of the present invention wherein a motorized air intake serves to collect air in the lower portions of the building interior or the aforementioned second zone where the cool air is collected. This air is then directed to the intake portion of the air conditioning assembly. In this fashion, the air conditioning assembly is utilizing an air supply which is already substantially reduced in temperature from that of say ambient temperature conditions or from air surrounding the building and the air conditioning unit itself.

The reverse operation occurs in the winter or cooler months wherein it is necessary to heat the interior of a building. A return duct system includes an air intake which collects only "heated" air from the first zone of the building interior adjacent to the uppermost collection state adjacent to the ceiling. Accordingly preheated air is fed to the air conditioning assembly thereby necessitating less expenditure of energy in the reheating of previously heated or collected heated air.

In order to accomplish the above in terms of air supply from "preconditioned" air within the building interior, a return duct is provided including at least one but preferably a plurality of ducts each having a first air intake located in the aforementioned first zone and a second air intake spaced along the length of the return duct but located at the lowermost portion of the building interior in the second zone. The first and second air intakes of the return duct therefore selectively gather and supply to the air conditioning assembly either preheated or precooled air. Also, structure is provided such that the operation of one air intake serves to concurrently close and prevent air flow into the second air intake.

Further ventilating features associated with the system of the present invention include exhaust means located in the first zone for the expulsion to atmosphere of heated air of sufficient temperature or quantity tending to modify or expand beyond the preset or predetermined limits of the first zone. Expulsion of this "excess heated air" thereby occurs through operation of an exhaust facility in terms of at least one and preferably a plurality of motorized exhaust fans located throughout the first zone or collection space for heated air. However, it is important that the "excess heated air" collected in the upper portion or zone is not to be inadvertently exhausted or wasted during the winter months but used again to heat the interior of the building being conditioned. In order to avoid such inadvertent escape or loss of the heated air, motorized dampers may be placed in covering relation to the exhaust fan wherein such motorized damper is automatically opened and closed upon activation of the motorized exhaust fans which they cover.

At least one but preferably a plurality of motorized dampers are located in the wall structure of the building throughout its interior and are concurrently operated in synchronized fashion such that the motorized dampers open allow inflow of exterior air into the interior of the building upon activation of the exhaust means so as to maintain the predetermined zone within the building interior in balance.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
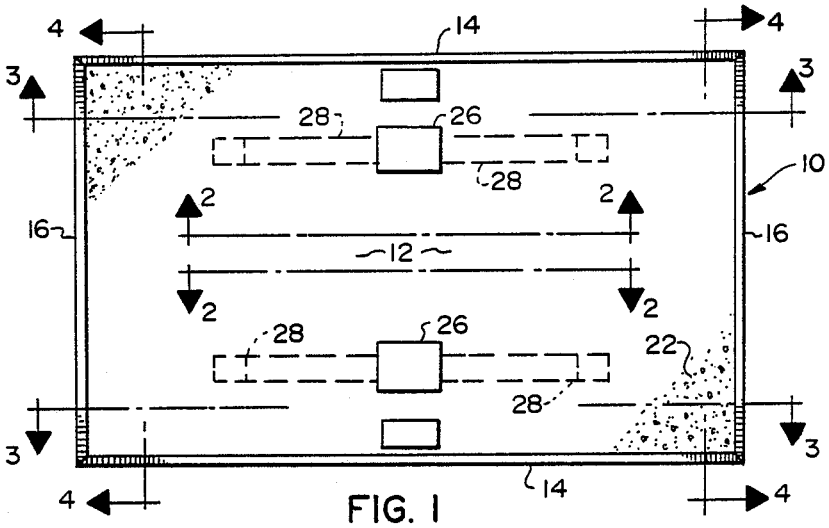
FIG. 1 is a top plan view in schematic form of a building interior and location of air conditioning and supply duct portions of the subject system.

As shown in FIGS. 1 through 4, the present invention is related to a system for the heating and cooling of a building structure generally indicated as 10. It should be emphasized that the generally schematic representations of the building structure are representative only and the fact that the "building interior" 12 is generally shown as being of a single room is not intended to be limiting. The system is totally adaptable to various building structures including multi-story, multi-room designs wherein the size and shape of a particular building interior 12 dictates the number, dimension and disposition of the various structural components of the system to be described in greater detail hereinafter.

Accordingly, the building structure 10 includes typical exterior side walls 14 and 16, a roof and ceiling structure 18 and 20, and a floor 22. The interior 12 of the building structure 10 is to be conditioned to the extent of providing sufficient quantities of cooled or heated air of course depending upon the outside temperature and seasonal conditions.

Figure 2:
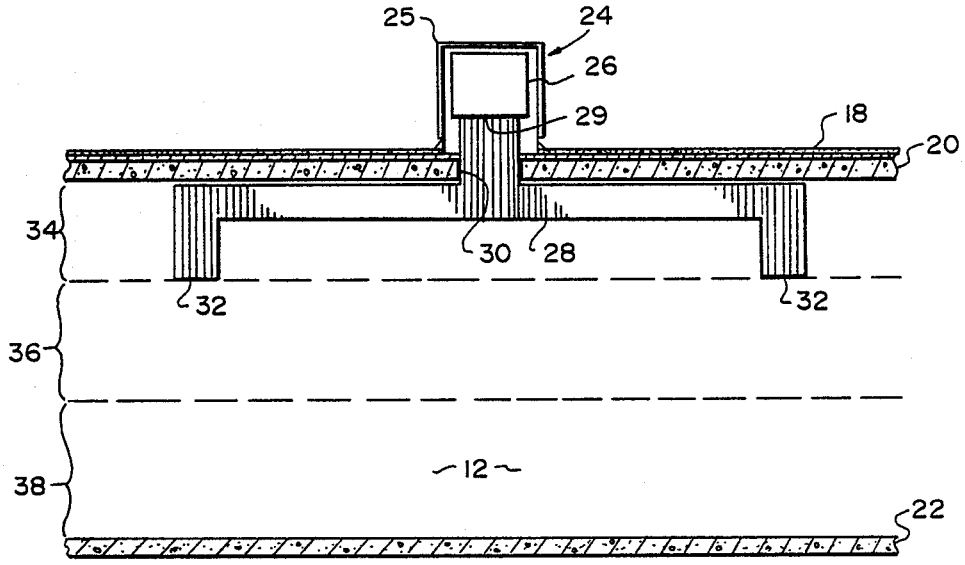
FIG. 2 is a side view along line 2—2 of FIG. 1 showing supply conduits associated with the subject air conditioning assembly and their deliverance into the building interior.
Figure 3:
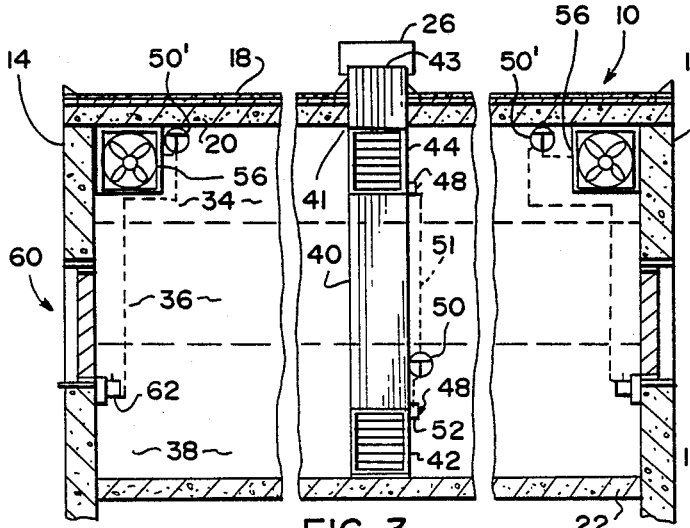
FIG. 3 is a sectional view along lines 3—3 of FIG. 1 shown in partial cutaway form.
Figure 4:
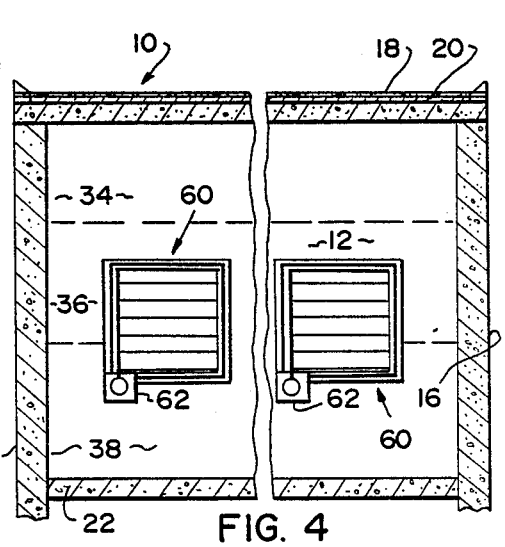
FIG. 4 is a sectional view in partial cutaway along lines 4—4 of FIG. 1.

The present invention therefore comprises an air conditioning assembly generally indicated as 24 and including at least one but preferably a plurality of air conditioning units as at 26, wherein the number of actual air conditioning units is dependent upon the size and/or configuration of the interior 12 to be maintained within given temperature parameters. Further, the air conditioning assembly 24 is schematically represented and includes a housing or casing 25 surrounding the unit 26. The air conditioning unit is of the type which is capable of operating in either an air cooling or air heating mode so as to deliver cooled or heated air by an air delivery means in the form of at least one or preferably a plurality of air return ducts 28. While disclosed in FIG. 2 as a single unit, the air conditioning assembly 24 may in fact comprise separate units including a separate condensor unit and air handler unit working in cooperation with one another. In addition, while FIG. 2 shows the air conditioning assembly 24 located on the exterior of the building, this is meant to be representative only in that the air conditioning assembly may be in fact located on the interior of the building.

One end of the air delivery assembly or duct as at 29 is connected to the appropriate positioned air conditioning unit 26 so as to receive conditioned (heated or cooled) air directly therefrom. The delivery duct passes through aperture or like passageway structure 30 for direct communication as at 29 to the air conditioning unit or units 26. The opposite or delivery end of the delivery duct 28 is indicated as vent or outlets 32 which are purposely disposed in depending relation to the exposed surface of the ceiling 20 so as to extend down into the interior of the building as at 12 a distance to deliver the treated air to appropriate portions of the interior 12.

More specifically and as will be explained in greater detail hereinafter, the interior 12 of the building may be appropriately divided into a first zone 34, a second zone 38 and a third zone 36. The first zone 34 is located adjacent to and extending downwardly from the ceiling 20 and is defined by a collection space for the warmer air within the interior 12 of the building 10. The heated air, according to common connection rules will of course rise and thereby define the collection space immediately below the ceiling 20 of the first zone 34.

A second zone 38 may also be referred to as a comfort zone and is the area generally occupied by people, machinery, utilities, etc. While specific distances are not crucial and are not provided for the purpose of limiting the present invention, the second or comfort zone 38 may extend to approximately 8 feet above the floor 22. Such distance may be increased or decreased depending upon the particular purpose or application to which the building 10 generally and the interior 12 more specifically is intended. Again referring to the conventional rules of convection, the cooler air will collect in the space immediately above the floor 22 defined herein as the second zone or comfort zone 38.

The third zone 36 may generally be referred to as an intermediate zone serving as a transitionary space between the collection zone for warmer air of the first zone 34 an the collection space for cooler air of the second zone 38. For purposes of efficiency, the outlets 32 of the supply duct 28 channelling conditioned air (either hot or cold) into the interior 12 extends at least through the first zone 34 such that the conditioned air preferably issues into the third zone 36 defining the transitionary space of the interior 12 as set forth above.

An important feature of the present invention is the air return means which feeds air to the intake portion of the air conditioning unit or units 26. In a preferred embodiment of the present invention, this air return means comprises at least one and preferably a plurality of return ducts 40 mounted on the building interior 12 and including a first air intake 42 and a second air intake 44. First and second air intakes 42 and 44 are purposely located in spaced relation to one another along the length of the return duct 40 and also purposely disposed at the opposite extreme heights within the building interior 12. More specifically, the first air intake 42 is located in the second zone 38 wherein when activated to allow air flow to pass therethrough, channels air present in the collection space for cooler air or end zone 38, up through supply duct 30 to an intake 43 of the air conditioning unit 26. Similarly, the second air intake 44 is located in the first zone 34 such that when activated to allow air flow to pass therethrough only the warmer air present within the collection space defined by the first zone 34 is passed through the supply duct 40 and into the intake portion 43 of the air conditioning unit 26. Proper passage is provided as at 41 to allow the appropriately positioned end or portion of the supply duct 40 to pass through the ceiling and roof structure 20 and 18 respectively to reach the intake 43 of the air conditioning unit 26.

Accordingly, when the air conditioning unit 26 is an operative mode, air is supplied thereto which is either cooled below ambient exterior temperature (second zone 38) or heated above ambient exterior temperature (first zone 34). The supplied air may therefore be effectively cooled or heated and therefore be more efficient when the air conditioner 26 is operating in an air cooling mode or an air heating mode respectively.

By way of operation and example, during the summer months or during warm weather conditions, the air conditioning unit 26 will be operating in an air cooling mode. Accordingly, air intake 42 will be open and concurrently air intake 44 will be closed. Accordingly, the air supplied to the intake 43 of the air conditioning unit 26 for further conditioning will be collected from the collection space defined by the second zone 38 and therefore be substantially cooler than ambient external air. Less energy will therefore be consumed since less work must be done in the further reducing of the supplied air (from the cold air collection space defined by second zone 38) in order to further condition the supplied air to the preselected and desired cooled temperature.

Conversely during the winter months or during cold weather conditions, the air conditioning unit 26 will be operating in an air heating mode. Accordingly, air intake 42 will be closed and concurrently air intake 44 will be open. Therefore, all air supplied to the intake portion 43 of the air conditioning unit 26 will already be at a substantially raised temperature since only the heated air will be present in the collection space defined by the first zone 34. Again, less energy will be consumed in further heating the conditioned air issuing from the air supply or vents 32 (see FIG. 2).

In order to control proper supply of air from the appropriate zone to the air conditioning unit 26, each of the air intakes 42 and 44 includes an operative shutter which are interconnected by conventional linkage (not shown) such that the opening of one of the shutters associated with either of the air intakes 42 or 44 serves to close the opposite shutter associated with the other of the two air intakes 42 and 44. Such opening and closing can be done by mechanical means such that manual operation of a throw lever 48 or the like may serve to regulate or properly position the open and closed positions of the shutters associated with each of the air intakes 42 and 44. Alternately, a thermostatic control means 50 may be located somewhere in the comfort zone or second zone 38 so as to operate a motor 52 interconnected to the thermostatic control by proper electrical conductors 51. The same thermostatic control 50 of course will serve to activate the air conditioning unit or units 26 in either an air cooling or air heating mode dependent upon the temperature within the comfort zone 38.

Another feature of the present invention includes an exhaust means in the form of at least one but preferably a plurality of exhaust fans 56. The exhaust fans are dependent in number and location again on the size and configuration of the building interior 12. In each instance however, the exhaust means includes a plurality of exhaust fans 56 which are structured and disposed on the building 10 so as to be vented to atmosphere. Activation of the exhaust fan is made for the purpose of releasing the collected warmer air within the collection space of the first zone 34 to the extent that when the quantity of warmer air collected in the first zone 34 exceeds a certain limit, the exhaust fans 56 will be activated thereby venting the collected warmer air within the first zone 34 to atmosphere.

The thermostatic control means of the present invention therefore not only includes the location of thermostat 50 within the comfort zone but the location of thermostat 50' at a highest location within the building interior 12 as indicated by thermostatic control 50'. Accordingly, upon reaching a preset temperature, the thermostatic control 50' serves to automatically activate the exhaust fan 56. In addition, a motorized damper is associated with each of the exhaust fans 56 and provided in the appropriately positioned side walls 14 and/or 16. The thermostatic control 50' is further interconnected to a drive motor means 62 for purposes of activating the damper between either an open or a closed position so as to allow air flow to enter the interior 12 from the exterior preferably at the third zone 36. This will have the effect of reducing the temperature in the first zone 34 as the exterior incoming air enters the interior and passes through intermediate or third zone 36. Further with regard to the operation of exhaust fan 56, it is of course important that the collected hot or heated air in the uppermost zone indicated as 34 not be exhausted except during the summer months when it is exhausted on purpose through the operation or activation of exhaust fans 56. However, during the winter months, it is important to maintain the heated air in the zone indicated as 34 and prevent inadvertent exhaust or leakage of the heated air therefrom to the exterior of the building. Accordingly, in order to accomplish the maintenance of the heated air within the zone 34, motorized dampers may also be associated with the exhaust fans 56 which are not shown in the drawings provided. These motorized dampers may be positioned between the exhaust fans and the exterior of the building and may be interconnected to open when the exhaust fan is activated and closed tightly when the exhaust fan is deactivated. Again, these exhaust fans may be of conventional design and common configuration and for purposes of clarity are not shown herein.

Based on the above, it can be seen that the subject air conditioning assembly 24 is allowed to operate at greater efficiency expending less energy in order to accomplish cooling or heating of the building interior 12 based on the fact that the supply air itself is fed at either a reduced or raised temperature depending upon the location within the building interior 12 from which it is collected. Appropriate filters of course can be utilized throughout the system in order to freshen any air coming from the interior of the building 12. Further, during colder weather conditions the heat generated by people, machines, etc. is used to maximum advantage.

It is therefore to be understood that the following claims are intended to cover all of the generic and specific features of the invention herein described, and all statements of the scope of the invention which as a matter of language, might be said to fall therebetween.

Now that the invention has been described, What is claimed is:

1. A system for the cooling and heating of the interior of a building structure, said, system comprising:

(a) an air conditioning assembly mounted on the building structure, said air conditioning assembly structured to selectively heat and cool air passing into the building interior, (b) a delivery duct assembly connected to said air conditioning assembly substantially at one end thereof and extending into the building interior at an opposite end of said delivery duct assembly, (c) said delivery duct assembly including at least one elongated delivery duct disposed and structured to direct conditioned air issuing from said air conditioning assembly into said building interior, (d) air return means for delivering air to an intake portion of said air conditioning assembly and comprising at least one return duct disposed at least in part within the building interior, (e) said one return duct comprising a first air intake located along the length of said return duct in a lowermost zone of the building interior and a second air intake located along the length of said return duct in an uppermost zone of the building structure, (f) said first and said second air intakes each comprising an air damper structured for selective movement between an open and a closed position, said air dampers interconnected to one another for concurrent reverse positioning; and motor means for electrically positioning said interconnected air dampers between said open and closed positions, thermostatic control means connected in activating relation to said motor means and said air conditioning assembly for concurrent positioning of said air dampers by activation of said motor means and operation of said air conditioning assembly.

2. A system as in claim 1 wherein said uppermost zone is defined by a first collection space within said building interior adjacent a ceiling thereof, said first collection space disposed for collection of warmer air within the building interior.

3. A system as in claim 2 wherein said lower zone is defined by a second collection space within said building interior adjacent a floor thereof and extending upwardly therefrom to a height occupied by people within the building interior.

4. A system as in claim 3 wherein said second collection space is disposed for collection of cooler air within the building interior.

5. A system as in claim 4 wherein said thermostatic control means is structured to close said first air intake and concurrently open said second air intake when said air conditioning assembly is set to operate in an air heating mode, said second air intake disposed and operative to deliver warm air from said first collection zone to said intake of said air conditioning assembly.

6. A system as in claim 4 wherein said thermostatic control means is structured to close said second air intake and concurrently open said first air intake wherein said air conditioning assembly is set to operate in an air cooling mode, said first air intake disposed and operative to deliver cool air from said second collection zone to said intake of said air conditioning assembly.

7. A system as in claim 1 wherein said delivery duct comprises a distal end thereof disposed remote from said air conditioning assembly and within the building interior at a position at or beneath said uppermost zone, an air outlet at said distal end and disposed to deliver air flow from said air conditioning assembly to within the building interior at a location below said uppermost zone.

8. A system as in claim 3 further comprising exhaust means disposed within said building interior in said uppermost zone and disposed in fluid communication between said uppermost zone and atmospheric exterior of the building structure.

9. A system as in claim 8 further comprising a damper assembly including at least one motorized damper mounted on the building structure in fluid communication between the interior and exterior of the building structure, said motorized damper disposed in a third zone positioned intermediate said uppermost and lowermost zones, said third zone defined by an intermediate space disposed within the building interior in a transitional location for air passing between said uppermost and lowermost zones.

10. A system as in claim 9 wherein said motorized damper is selectively positionable between an open position and a closed position, whereby air flow from the exterior of the building is regulated.

11. A system as in claim 10 wherein said thermostatic control means comprises an auxiliary control disposed to regulate temperature within said uppermost zone and operatively interconnected to both said exhaust means and said motorized damper for concurrent operation thereof.

12. A system as in claim 11 wherein said concurrent operation of said motorized damper and said exhaust means simultaneously exhaust air from said uppermost zone and draws air in from the exterior into the building interior through said third zone.

* * * * *